United States Patent [19]

Reddoch

[11] Patent Number: 4,982,787

[45] Date of Patent: Jan. 8, 1991

[54] PIPE WIPER SYSTEM

[76] Inventor: Jeffrey A. Reddoch, 104 Ramblewood Dr., Lafayette, La. 70508

[21] Appl. No.: 495,470

[22] Filed: Jan. 2, 1990

[51] Int. Cl.[5] ..... E21B 33/08

[52] U.S. Cl. ..... 166/82; 166/84; 175/84

[58] Field of Search ..... 166/81-85, 166/75.1; 175/84; 15/102, 210 B, 104.04; 251/1.1, 1.2, 1.3; 277/30, 31, 198

[56] References Cited

U.S. PATENT DOCUMENTS

| | | | |
|---|---|---|---|
| 2,718,021 | 9/1955 | Baebel | 15/102 |
| 2,809,012 | 10/1957 | Stevens | 15/210 B |
| 3,733,641 | 5/1973 | Brown | 166/82 X |
| 4,457,366 | 7/1984 | Brown | 166/82 |
| 4,690,213 | 9/1987 | Stannard et al. | 166/84 |

FOREIGN PATENT DOCUMENTS

| | | | |
|---|---|---|---|
| 220652 | 4/1985 | Fed. Rep. of Germany | 166/85 |

*Primary Examiner*—Hoang C. Dang
*Attorney, Agent, or Firm*—John D. Jeter

[57] ABSTRACT

A pipe wiper assembly for stripping fluid form well strings has a container, with side walls, for use above the well head. Inside the container a frame is situated for some limited horizontal movement and the frame contains a pair of wiper blades in a horizontal guideway. The wiper blades move in opposite directions in the guideway between open and closed positions by way of forces provided by fluid power cylinders mounted on the frame and attached to the wiper blades. In the open position, the wiper blades are clear of the well string and in the closed position they are pressed against the well string. The wiper blades are vertically stacked in the closed position and overlap to assure full circumferential wiping of the well string. The frame is tethered to the container to prevent rotation due to well string friction. The cylinders are provided with fluid power by way of flexible hoses.

15 Claims, 2 Drawing Sheets

PIPE WIPER SYSTEM

This invention pertains to a pipe wiper device to be used at well heads to strip fluids from the outer surface of tubular articles being pulled from a well.

BACKGROUND OF THE INVENTION

When a tubular string is pulled from a fluid filled well some fluid clings to the outer surface of the string, or pipe. The pipe is separated into selected lengths for handling and usually stands vertically on the rig floor, extending up into the derrick, until reassembled and put back into the well. The fluid drips down on the rig floor to create waste, hazard and pollution. It has, for years, been a practice to use some means to strip the fluid from the pipe surface as the string moves upward through the drilling floor and to direct the recovered fluid back to the fluid handling system.

The pipe wiper system is commonly placed below the drilling floor, and above the well head. The well head is usually fitted with a funnel opening upwardly near the wipers to gather the stripped fluid. Some pipe wipers are simple bushings of resilient material that snugly fit the pipe but are sufficiently resilient to stretch over tool joints moving upward while the bushing is tethered to the structure. Such bushings have to be removed for the passage of stabilizers and other large components of the string. Other pipe wipers have laterally movable arcuate wiper blades that can be forced against the pipe for wiping action or moved away to clear the string. Such wiper blades are resilient and shaped to overlap when against the pipe. To permit overlap, the blades are usually spaced apart vertically. Such wiper systems are usually fluid powered for opening and closing on the pipe, with the fluid power controlled by valves accessible to personnel on the rig floor.

The drill string, when suspended from the hook, usually moves laterally around the interior of the larger well head. The pipe wiper must accept this lateral movement and still perform as intended.

There is a need for a wiper system that can be opened and closed on the pipe by action of fluid power controlled by the driller, yet of such compactness that it can be installed and removed through the opening in the rig floor.

It is therfore an object of this invention to provide a pipe wiper assembly in a containing funnel, attachable to the well head, within which a wiper blade assembly can move laterally in sympathy with movement of the pipe string.

It is another object of this invention to provide a pipe wiper assembly sufficiently compact to be lowered into position, and removed, through the rotary table opening in tbe rig floor.

It is a further object of this invention to provide a pipe wiper assembly that is compact and responsive to fluid power control manipulations to open the wiper to clear the pipe string and to close the wiper to strip fluid from the pipe.

These and other objects, advantages, and features of this invention will be apparent to those skilled in the art from a consideration of this specification, including the attached claims and appended drawings.

SUMMARY OF THE INVENTION

An upwardly opening funnel shaped container is arranged for attachment to the well head. A pipe wiper blade assembly with two opposed wiper blades fits into the container with some lateral clearance to admit some lateral movement therein. The wiper blades are situated within a frame comprising a generally central opening to accept pipe therethrough, lateral tracks to confine and direct laterally movable wiper blades, a plurality of fluid power cylinders attached to the frame and arranged to move the wiper blades between an open position, clearing the pipe, and a closed position, against the pipe, and a plurality of tethers to attach the frame to the container to prevent the frame from rotating when pipe rotates. The blades are arcuate shaped, at least part elastomer, and arranged to somewhat overlap where the pipe is contacted. To allow the blades to overlap, the tracks are separated and spaced apart vertically. Fluid power from an external source, usually rig power, is plumbed to the cylinders, with associated valving accessible to rig personnel for control or the wiper blade positions. The tethers are arranged to allow the frame to move laterally, within limits, within the container.

BRIEF DESCRIPTION OF DRAWINGS

In the drawings wherein like captions pertain to like features.

DETAILED DESCRIPTION OF DRAWINGS

Figure 1:
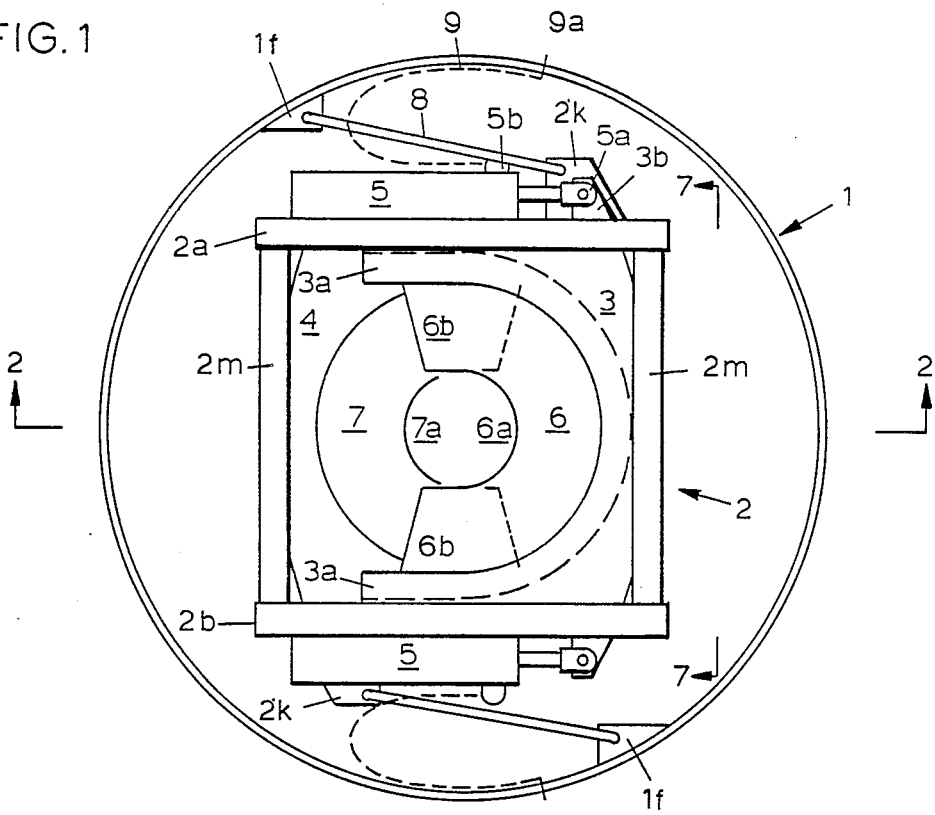
FIG. 1 is a plan view of the preferred embodiment of the system.

In the drawings, some features commonly used for manufacturing and maintenance utility, such as threaded fasteners and weld beads and the like, but not bearing on points of novelty, are omitted in the interest of descriptive clarity.

In FIG. 1, the view is down the axis of a well bore. Container 1 is commonly fastened to a well head and represents the configuration that may be seen through the central opening of a rig floor. The wiper blades 6 and 7 are in the closed position, that position used to strip fluid from pipe, not shown, moving upward through the opening formed by arcs *6a* and *7a*. Wiper blades 6 and 7 are quite resilient, usually rubber, and arcs *6a* and *7a* may be only narrow slits before being deformed into arcs as shown when forced against a pipe periphery.

The frame comprises opposed rail assemblies *2a* and *2b*, spaced apart by plates *2m* and *2n*. In channels, shown more clearly later, wiper carriers 3 and 4 move outward from the position shown to the right and left respectively, urged by power cylinders 5 attached to the frame and the carriers. Cylinders 5 actuate carrier 3 by way of rod and clevis *5a* and carrier lugs *3b*. A similar set of cylinders 10 (not shown) is situated below with rods extending to the left to actuate carrier 4. The cylinders may have internal springs to urge the carriers open, and use fluid power only to close the wipers as shown.

Fluid power, usually rig air pressure, delivered by external plumbing to ports 9a moves through hose 9 and inputs 5b, (and 10b not shown) to actuate the cylinders. The wiper lugs, 3b shown, extend through the rail assemblies by way of notches 2d and 2j. The cylinders are bolted to the side of the frame.

Figure 2:
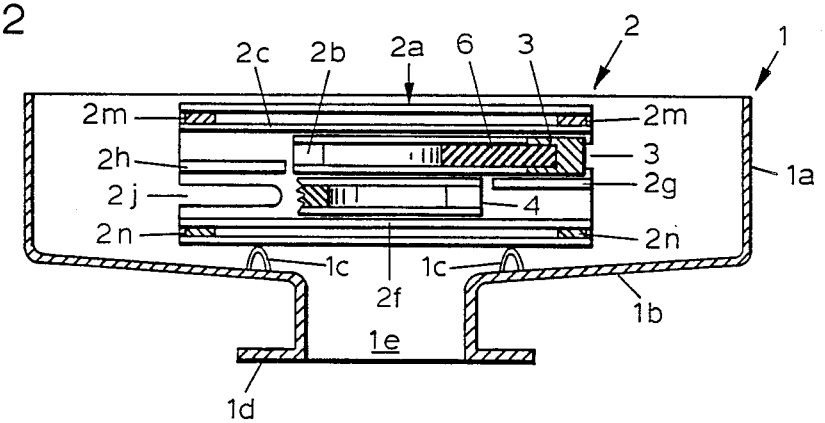
FIG. 2 is a side view, in cutaway, taken along line 2—2 of FIG. 1.
Figure 7:
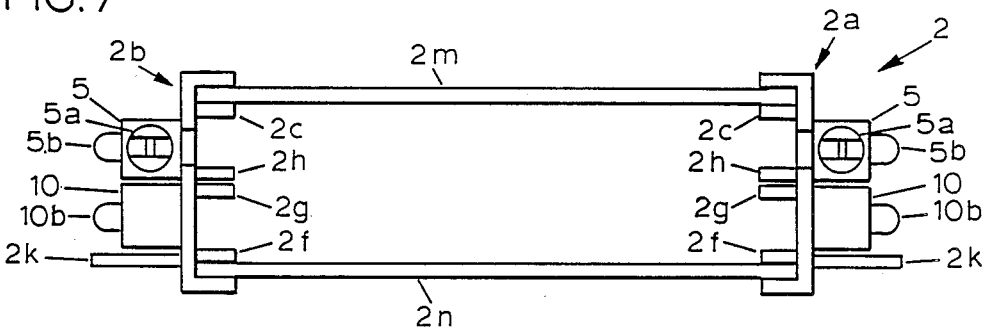
FIG. 7 is a side elevation of part of the system of FIG. 1 taken along line 7—7.

In FIG. 2, some details are shown which can be more clearly seen in FIG. 7. The inside of rail assembly 2a is shown. Wiper carrier 4 rests on wear rail 2f which is welded to the frame. Carrier 3 rests on top of carrier 4 when closed and is supported by confining rail 2g when moved to the open position. Rail 2g is welded to the rail assembly. Carrier 4 is confined by confining rail 2h when it moves to the left to the open position.

In some cases, rails 2g and 2h are replaced by a single rail extending the full length of the rail assembly, separating the carriers and providing a supporting wear rail for carrier 3 and a confining rail for carrier 4.

The carriers are structurally identical with lugs extending through notches 2d for carrier 3 and notches 2j for carrier 4. Rail assemblies 2a and 2b are functionally identical configured for opposed location.

Container 1 has walls 1a to retrieve splash and dished basin 1b with a tubular extension to well attachment flange 1d. Rails 1c are welded to the basin to support the frame and are ported to allow fluid to pass to bore 1e. Bore 1e is the upper end of the well bore when in field use.

Two tethers 8 extend from container lugs 1f to frame lugs 2k to prevent rotation of the frame relative to the container. The tethers may be flexible to allow the frame to move about laterally some amount in the container. To prevent rotation in either direction, rigid tethers pivotably attached to the lugs may be used. Hose 9 is looped to allow lateral movement of the frame.

Figure 3:
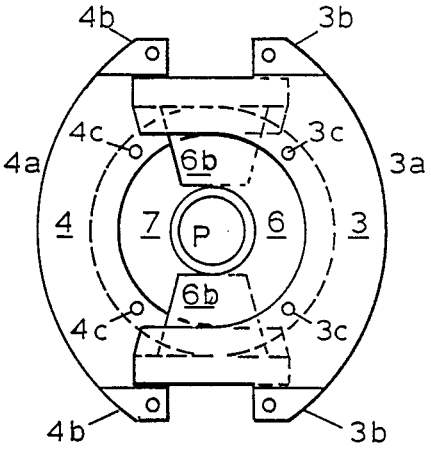
FIGS. 3 and 4 are plan views, from the perspective of FIG. 1 showing only selected elements in first the closed position, then the open position.
Figure 4:
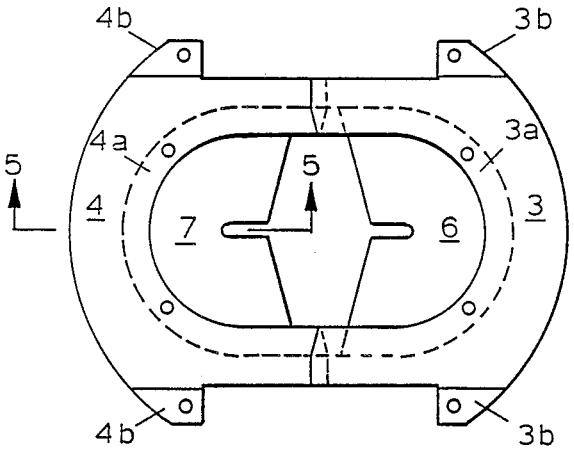

FIGS. 3 and 4 show the closed and the open relationships of the wiper carriers 3 and 4 and the attached wiper blades 6 and 7. No frame and no attachments are shown. Carrier 3 slides atop carrier 4. When closed, they have a stacked relationship. When open, only the inner ends of the carriers overlap. Pins 3c and 4c secure the wiper blades within the securing grooves of the carriers.

Figure 5:
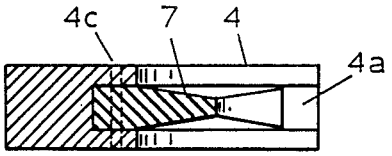
FIG. 5 is a section of one part of the assembly of FIG. 4 taken along line 5—5.

FIG. 5 shows carrier 4, sectioned through the center along lines 5—5 of FIG. 4. Dotted pin 4c is shown out of position but shows the location relative to the receiving groove 4a.

Figure 6:
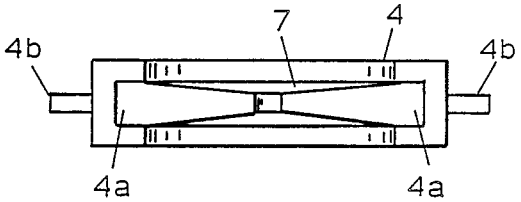
FIG. 6 is an orthagonal view of the assembly of FIG. 5 with none cut away.

FIG. 6 is a view of the right end of the carrier and blade of FIG. 5, with the total width shown.

FIG. 7 shows the empty frame (view from the right end, FIG. 2), with cylinder sets 5 and 10 attached. Frame lugs 2k are shown. Cylinders 10 are below cylinders 5 and have rods on the far end, out of view. Ports 10b, like ports 5b, are for fluid pressure to operate the cylinders. If unbiased cylinders are used, each cylinder is provided with two such ports for fluid forced movement of the associated rods in both opening and closing actions. Such arrangements are well established in the art and are not shown. For such arrangements, two hoses such as 9 are needed and the external valving, also in the art, is used to select the action needed.

From the foregoing, it will be seen that this invention is one well adapted to attain all of the ends and objects hereinabove set forth, together with other advantages which are obvious and which are inherent to the method and apparatus.

It will be understood that certain features and subcombinatIons are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. In a pipe wiper assembly for stripping fluid from the outer surface of a well string, the assembly comprising a container having side walls, a pair of pipe wiper blades situated within said container and movable between an open position, wherein they are disassociated from the well string, and a closed position, wherein they are pressed against the well string, the improvement comprising:

a frame situated within said container, for limited horizontal movement therein, having a horizontal guideway to accept said pipe wiper blades for movement from opposite sides of said well string between said open and said closed positions;

a pair of fluid power cylinder assemblies for each of said pipe wiper blades, mounted on said frame, arranged for linking said frame and said pipe wiper blade for movement between said open and said closed positions; and flexible means, connected to said fluid power cylinder assembly, for supplying fluid power thereto.

2. The pipe wiper assembly of claim 1 wherein said pipe wiper blades are vertically separated and arranged to overlap when in said closed position.

3. The pipe wiper assembly of claim 2 wherein said guideway is divided into an upper portion for one said pipe wiper blade by a supporting wear plate attached to said frame and a lower portion for the other of said pipe wiper blades.

4. The pipe wiper assembly of claim 1 wherein said pipe wiper blades each comprise a rigid carrier portion and a flexible wiper portion thereto attached and arranged to contact said well string and flex to conform to a portion of the circumference of said well string.

5. The pipe wiper assembly of claim 1 wherein at least two flexible tethers extend from said frame to said container to limit rotation of said frame about said well string.

6. An improved wiper assembly for stripping fluid from the outer surface of a well string, the assembly comprising, a container with side walls, a frame disposed for some horizontal movement therein, said frame having at least one horizontal guideway therein, a pair of opposed wiper blades situated in said guideway for horizontal movement therein between an open position, wherein they are dissassociated from said well string, and a closed position, wherein they are pressed against said well string, the improvement comprising:

a fluid powered cylinder, piston, and rod assembly mounted on each of two sides of said frame for each of said wiper blades and connected to said wiper blades for opening and closing them, said rods attached to one of said wiper blades extending in an opposite horizontal direction relative to said rods for the other said wiper blade, and flexible fluid power hoses for said fluid power cylinders arranged to provide fluid power to actuate said wiper blades between said positions.

7. The improved wiper assembly of claim 6 wherein each of said wiper blades is provided with a lug on each of two sides extending through openings in said frame for attachment to said rods.

8. The improved wiper assembly of claim 6 wherein each of said wiper blades comprises a flexible wiper element attached to a rigid carrier.

9. The improved wiper assembly of claim 6 wherein said wiper blades are positioned in a vertical stacked relationship with one wiper blade generally disposed above the other when in said closed position.

10. The improved wiper assembly of claim 6 wherein said wiper blades overlap when in said closed position.

11. The improved wiper assembly of claim 6 wherein at least two tethers are attached to, and extend between, said frame and said container and are arranged to accept some horizontal movement, but limit rotation, of said frame relative to said container.

12. The improved wiper assembly of claim 6 wherein said flexible fluid power hoses comprise a single hose, divided to provide fluid power simultaneously to all said fluid power cylinders to move them collectively toward at least said closed position.

13. The improved wiper assembly of claim 6 wherein each of said fluid power cylinder, piston, and rod assemblies is spring biased to urge said wiper blades toward said open position.

14. The improved wiper assembly of claim 6 wherein said fluid power cylinder, piston, and rod assemblies are provided with fluid power hoses arranged provide fluid power to move said wiper blades, collectively, toward each of said positions.

15. The improved wiper assembly of claim 6 wherein said guideway is divided into an upper and a lower portion, said division defined by at least one frame member providing support for one said wiper blade independently of the other of said wiper blades.

* * * * *

UNITED STATES PATENT AND TRADEMARK OFFICE

CERTIFICATE OF CORRECTION

PATENT NO. : 4,982,787
DATED : January 8, 1991
INVENTOR(S) : Jeffrey A. Reddoch

It is certified that error appears in the above-identified patent and that said Letters Patent is hereby corrected as shown below:

Title page,
Item [21], Application Number, should be corrected to read -- 459,470. --

Signed and Sealed this

Second Day of November, 2004

JON W. DUDAS
*Director of the United States Patent and Trademark Office*